US006085889A

United States Patent [19]

Weickmann

[11] Patent Number: 6,085,889

[45] Date of Patent: Jul. 11, 2000

[54] COIN GUIDING DEVICE

[75] Inventor: Bernhard Weickmann, Berlin, Germany

[73] Assignee: Wh Münzprüfer Dietmar Trenner GmbH, Germany

[21] Appl. No.: 09/198,756

[22] Filed: Nov. 24, 1998

[51] Int. Cl.[7] ..... G07F 1/04

[52] U.S. Cl. ..... 194/239; 194/344

[58] Field of Search ..... 194/329, 330, 194/335, 337, 344, 345, 239

[56] References Cited

U.S. PATENT DOCUMENTS 2,002,560 5/1935 Watling ..... 194/345

3,896,916 7/1975 Ruzic et al. ..... 194/337 X 4,274,528 6/1981 Walters et al. ..... 194/335

FOREIGN PATENT DOCUMENTS 44 37 813 4/1996 Germany .

*Primary Examiner*—F. J. Bartuska

*Attorney, Agent, or Firm*—Young & Basile, P.C.

[57] ABSTRACT

A coin guiding device (1) is proposed which contains a coin channel (2) as well as a device for steadying coins and containing a swivelling pressing member (4) with wedge-shaped surfaces (9, 10). The pressing member (4) has an intake (6), substantially parallel to one wall (5) of the coin channel (2) and delimited by a lateral guide 7. Moreover, the coin guiding device (1) has a runner (3) disposed after the pressing member (4).

11 Claims, 4 Drawing Sheets

COIN GUIDING DEVICE

Figures 1A, 1B:
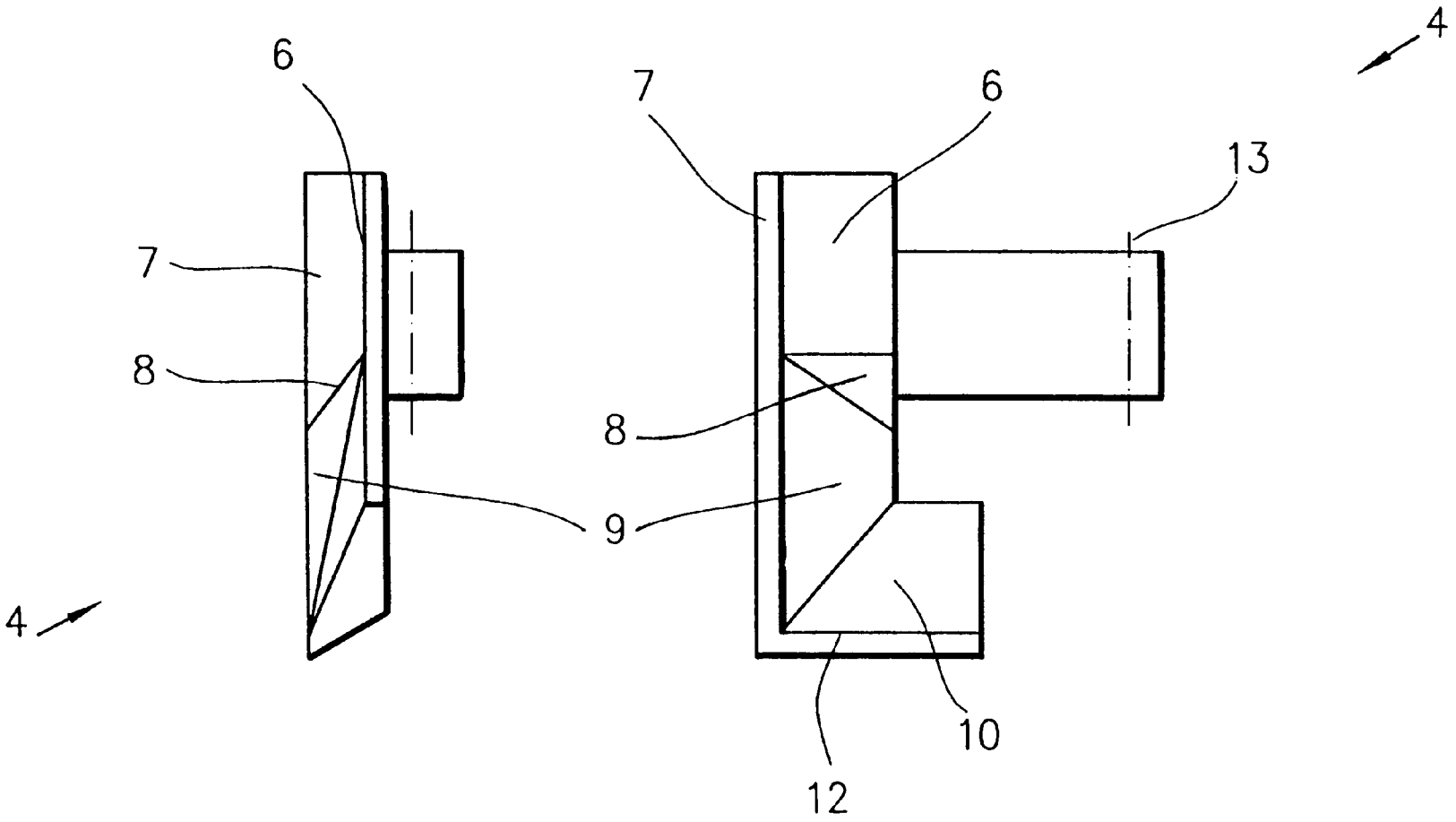

The present invention relates to a coin guiding device for coin appliances such as for example coin-acceptor units, which controls the braking of inserted coins and leads them in a pre-determined direction, according to the preamble of the main claim.

DE 44 37 813 describes a device for switching on a coin-acceptor unit or automatic machine. In this document, a swivelling pressing member with wedge-shaped surfaces and disposed in a coin channel is disclosed, which amongst other things serves to steady the coins. The pressing member is so disposed in the insertion path of the coin that, in order to steady the coins, an inserted coin is pressed by means of a pre-tensioned pressing member against a wall of the coin channel. To this end, the pressing member has two wedge-shaped surfaces disposed orthogonally in relation to one another, which guarantee braking of the coin both in a horizontal and in a vertical direction. With this appliance according to prior art, braking by wedging coins between one wall of the coin channel and the pre-tensioned pressing member is admittedly possible; where coins are coming in from different directions (and with different levels of impetus or twist) however, it is not possible to brake the coins and convey them further in a controlled and guided manner.

The purpose underlying the present invention, therefore, is to create a coin guiding device which, independently of the direction and strength of the impetus or twist of an inserted coin, completely steadies the coin in the narrowest space, so that it can be guided in an exactly defined manner for example to the measuring system in a coin-acceptor unit.

This purpose is fulfilled by a coin guiding device according to the preamble in conjunction with its characteristic features.

Through the fact that the pressing member has an intake substantially parallel to one wall of the coin channel and delimited by a lateral guide, and the coin guiding device has a runner disposed after the pressing member, an inserted coin can be channelled, braked and smoothly conveyed further on a pre-determined path. The lateral guide of the intake which is substantially parallel to one wall of the coin channel ensures first of all that the coin is braked in one spatial direction and simultaneously guided. After passing the intake according to the invention, the braking of the coin by means of wedge-shaped surfaces as well as the defined onward conveying of the coin is made possible by a runner disposed after the pressing member.

Advantageous developments of the device according to the invention are quoted in the dependent claims.

An advantageous development provides for the pressing member to have an intake slope in the transition region from the intake to the wedge-shaped surface. By this means, controlled transition and, moreover, further braking of the coin is made possible.

It is particularly advantageous that the pressing member has a first and a second arm with a first and a second wedge-shaped surface, the first and the second arm advantageously being substantially perpendicular to one another. The perpendicular arrangement of the two arms and thus of the wedge-shaped surfaces in relation to one another makes possible complete braking of the coin in two spatial directions and moreover a reduction in the twist on the coin.

A specially advantageous form of embodiment provides for the first arm to contain the intake as well as the adjoining first wedge-shaped surface and for the swivel pin of the pressure member and the first arm to be disposed perpendicular to the runner, and for the second arm to be substantially parallel to the runner. What is thereby achieved is that a falling coin is guided first of all perpendicular to the runner and then is completely braked in two spatial directions, and the steadied coin, which causes the pressing member to swing away, rolls away freely on the runner.

A further advantageous development provides for the guide to be so inclined in relation to the supply direction of a coin and/or the orientation of the gravitational field, that the coin rolls away on the guide. What is thus achieved through the inclination of the lateral guide is that, even when the coin bounces away briefly from the lateral guide, the contact between the lateral guide and the coin is soon re-established and thus the guiding of the coin is guaranteed in the best possible way.

A particularly advantageous form of embodiment provides for the pressing member to be able to assume a rest position as well as swung-out positions and for it to be able to be returned to its rest position by the force of its own weight. With this arrangement it is possible to dispense with spring elements for pressing or for returning the pressing member into the rest position. The production outlay is thus reduced and an unnecessary source of error is also avoided.

A further advantageous form of embodiment provides for the coin guiding device to contain a device for switching on a coin-acceptor unit and/or an automatic machine. This can be carried out by means of piezoelectric elements, a signal for switching on for example a coin-operated machine being given by the influence of pressure from the coins. However a pulse for switching on an automatic machine can also be provided by the relative movement of a permanent magnet, attached to the pressing member, with a reed contact or a ring winding.

Further advantageous developments are quoted in the remaining secondary claims.

The device according to the invention is now explained with the aid of the figures. These show:

FIGS. 1*a* and 1*b*—views of a pressing member according to the invention, FIGS. 2*a*–4*b*—views of a coin passing through a coin guiding device according to the invention.

FIG. 1*a* shows a pressing member 4 according to the invention with an intake 6 as well as a lateral guide 7 which is configured as a simple wall. FIG. 1*b* shows a further view of the pressing member according to the invention. From the views shown in FIGS. 1*a* and 1*b*, it is clear that an intake slope 8 exists between the intake 6, configured as a flat surface, and a wedge-shaped surface 9. This intake 6 as well as the adjoining wedge-shaped surface 9 belong to a first arm 11 of the pressing member 4. At right angles to this first arm is connected a second arm 12 which has a second wedge-shaped surface 10. It is advantageous to arrange the first arm 11 or the second arm 12 as well as the corresponding wedge-shaped surfaces 9 and 10 orthogonally in relation to one another, since by this means a coin coming in via the intake 6 in a plane which is parallel to the plane of the intake 6, can in a very simple manner be completely braked with the wedge-shaped surfaces 9 and 10.

FIG. 1*b* shows, moreover, an indicated pivot 13 around which the pressing member 4 may be swivelled. This pivot can be configured in many ways according to known art, for example with the aid of a pin which is led through eyes provided for same, a slide bush, a snap connection etc.

Figure 2A:
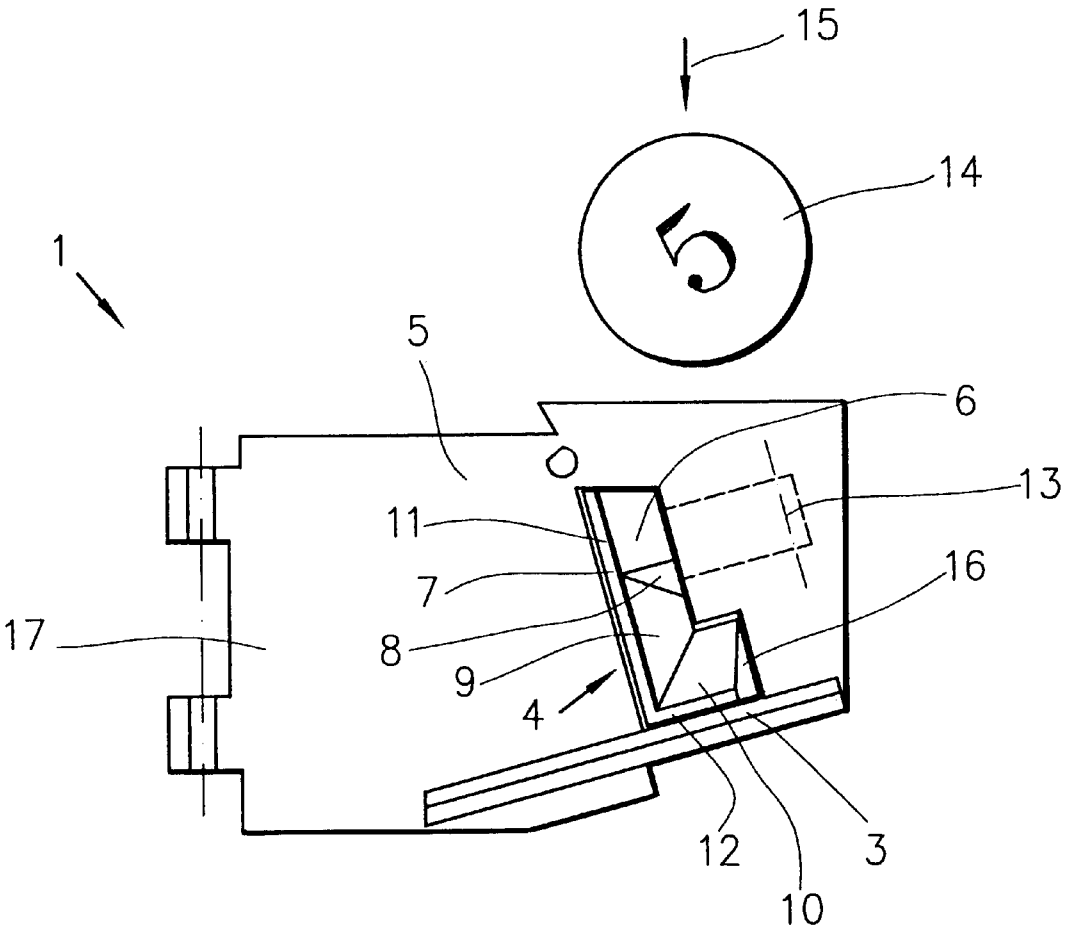

FIG. 2*a* shows a coin guiding device 1 according to the invention which contains a pressing member 4, described above (in contrast to the device in FIGS. 1*a* and 1*b*, the second arm 12 has a bevel 16). The pressing member 4 is connected via a swivel pin 13, not shown in detail, with the flap 17 of a coin acceptor unit. It is naturally also possible to attach the swivel pin at other points of the pressing member 4 e.g. along the upper edge of the intake 6. Swivelling around the swivel pin 13 is, however, particularly advantageous since even coins 14 with a very large diameter do not lead to jamming of the coin guiding device, and through a sideways swing of the pressing member 4 the path for the coin 14 along the runner 3 is cleared.

The flap, shown in FIG. 2*a*, of a coin-acceptor unit 17 forms simultaneously one wall of a coin channel 2 which can enclose coins on both sides. The pressing member 4 is here so integrated into the wall 5 of the flap 17 of a coin-accepted unit or of the coin channel 2, that when a coin channel 2 is closed, the intake 6 is disposed substantially parallel to a wall 5.

Figure 2B:
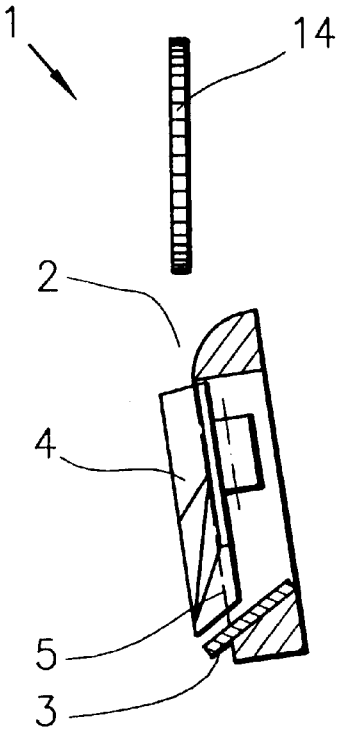

FIG. 2*b* shows a side view of the device depicted in FIG. 2*a*. The pressing member 4 projects clearly out of the wall 5 of the coin channel 2 or of the flap 17 of a coin-acceptor unit. In a folded-in position of the flap 17, a boundary surface 18 (see in this connection FIGS. 3*b* and 4*b* below) in such a way that, between the wall 5 and the boundary surface 18 parallel to same, substantially only a narrow gap or coin channel 2 remains, the width of which is matched to the coins 14 to be inserted. This width is also directly connected to the width of the runner 3.

As a result of folding in the flap 17 onto a boundary surface 18, there is slight swinging out of the pressing member 4, since this, as is clear from FIG. 2*b*, projects clearly beyond the runner 3. In order to avoid any jamming particularly of small coins as they run into the coin steadying device, a bevel 16 is provided in the region of the second arm 12 of the pressing member 4.

The place of the swivel pin 13 in relation to the pressing member 4, or the mass distribution of the pressing member 4, is to be designed in such a way that when there are no external influences, the force of its own weight returns the pressing member 4 into the rest position shown in FIG. 2*b*. When the flap 17 of a coin-acceptor unit is folded inwards against the boundary surface 18, the pressing member 4 is consequently guided against its own weight out of the rest position, and when the flap 17 opens, said member falls back through the force of its own weight into the rest position. Through the mass distribution sketched above or the place of the swivel pin 13, it is thus possible to dispense with additional devices for returning, such as springs.

This reduces the constructional and assembly outlay; furthermore, an additional source of errors is abolished. Likewise it is possible to dispense with a damping arrangement. The pressing member 4 according to the invention can be manufactured in the injection moulding process from suitable plastics, a variation in the mass or in the centre of gravity can also come about by additional weighting, e.g. through metal pieces in cavities provided for this purpose in the pressing member 4. According to the mass and extent of the coins 14 to be guided through the coin guiding device 1, both the size and the shape and position of the pressing member 4 can be varied. It is generally advantageous so to configure the intake 6 that it takes up approximately two-thirds of the length of the shorter flank of the first arm 11. According to the dispersion of the impetus of the falling coins 14, however, this distance can also be configured longer or shorter.

Figure 3A:
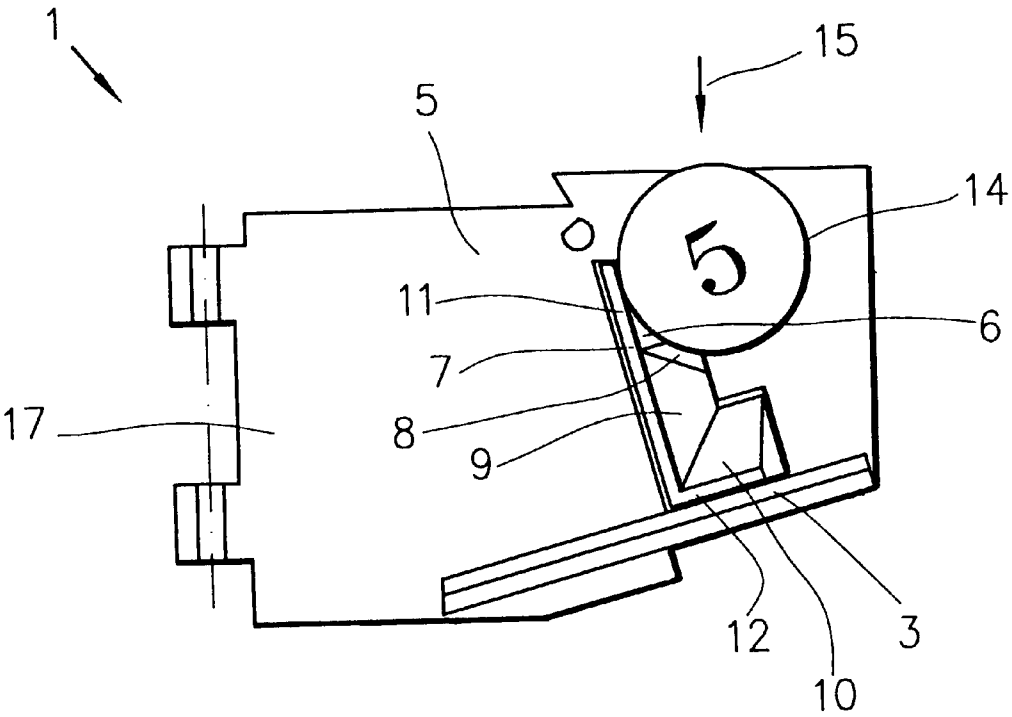
Figure 3B:
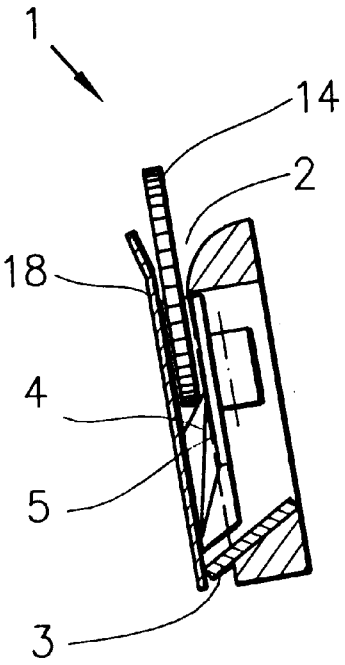

In relation to the supply direction 15 of the coins 14 (this coincides in the present case with the orientation of the gravitational field), the pressing member 4 is slightly inclined in the plane pre-determined by the coin channel 2. This ensures that the coins 14 are received better, i.e. that as intensive a contact as possible with the guide 7 is achieved, as shown in FIG. 3*a*. The first arm 11 is substantially perpendicular to the runner 3. The arm 12 adjoining the first arm 11 is disposed substantially parallel to the runner 3. It is advisable to provide a sufficiently steep inclination of the runner 3, such that a coin 14 steadied by the pressing member 4 does not remain too long on the runner 3, but soon rolls through the force of its own weight down from the runner 3. Naturally, designs other than the above-sketched angle ratios between the insertion direction 15, position of the first arm 11 or of the second arm 12 and of the runner 3 are also possible.

Figure 4A:
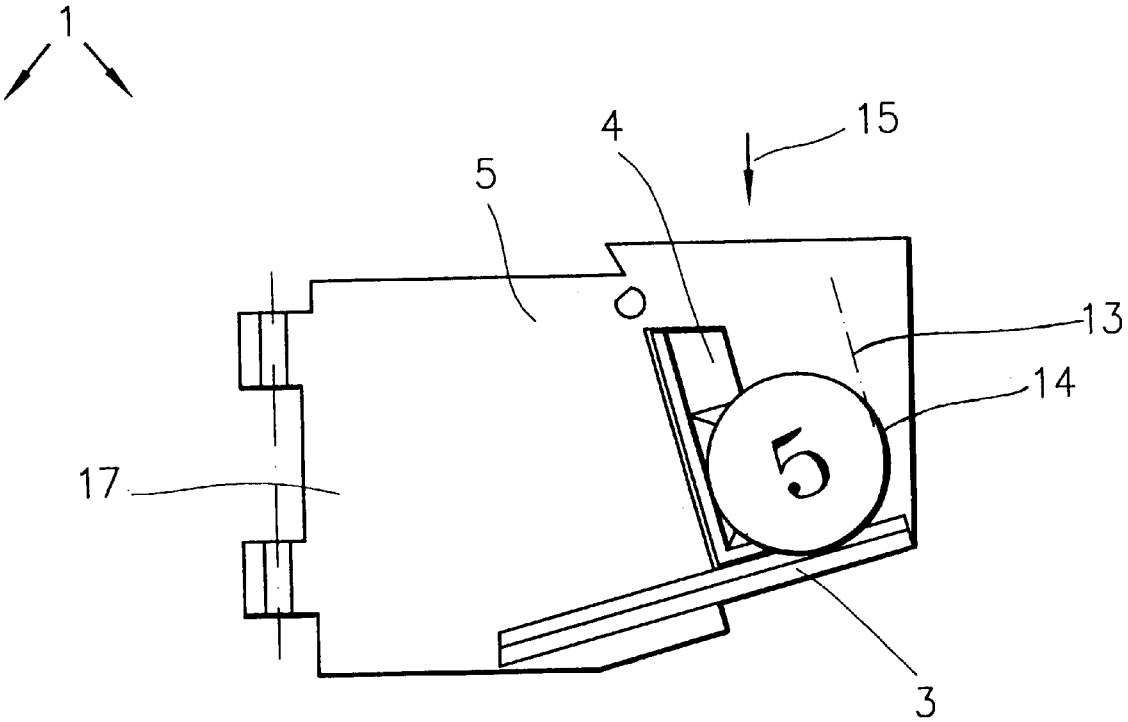
Figure 4B:
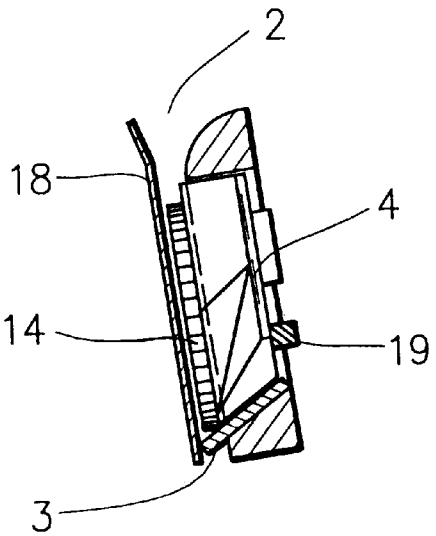

The passage of a coin 14 through a coin guiding device 1 according to the invention is quoted in FIGS. 2*a*–4*b*. FIG. 2*a* shows the coin 14 falling in the supply direction 15, which comes into contact in FIG. 3*a* first of all with the lateral guide 7. The coin is here braked in a direction perpendicular to the lateral guide 7. A part of its kinetic energy is here transformed into heat or deformation work; however it is also possible for a part of the impetus to be converted into a twist of the coin. The coin which is enclosed laterally by the wall 5 or the boundary surface 18, moves now along the inclined lateral guide 7 in the direction of the first wedge-shaped surface 9. In so doing, the coin passes, in the transition region between the intake 6 and the first wedge-shaped surface 9, an insertion slope 8 and slides along the wedge-shaped surface 9, in the direction pre-determined by the guide 7, towards the runner. During this process the coin is additionally braked on the second wedge-shaped surface 10. As a result of the coin 14 sliding along the wedge-shaped surfaces, the coin is further braked, moreover the pressing member 4 is swung out, as is shown in FIG. 4*b*. In this way the rolling of the braked coin 14 on the runner 3 is made possible.

The coin guiding device according to the invention contains in addition a device, not shown completely, for switching on a coin-acceptor unit or an automatic machine. By this means, the energy requirement of the automatic machine can be considerably reduced or the standby time considerably increased. This can be realised for instance in that a permanent magnet 19, which is attached to the pressing member 4 and protrudes from same, is disposed opposite the opening of a ring winding (not shown in detail here). The ring winding is here connected with a circuit for recognising a current pulse which in turn switches on the power supply of the coin-acceptor unit or of the coin operated machine. When a coin 14 drops in and the pressing member 4 consequently swings, the permanent magnet 19 engages with the aperture of the ring winding and the magnetic field induces a current in the ring winding. This pulse is recognised by the circuit (not shown in detail here) connected with the ring winding and correspondingly evaluated. (Switching on of the power supply of the coin-acceptor unit or automatic machine).

Instead of the solution shown here with a permanent magnet and a ring winding, a permanent magnet in co-operation with a reed contact can naturally also be used in an analogous fashion. In addition, it is also possible to provide within the coin guiding device piezoelectric elements which, when there is pressure from the coins, release a signal for switching on the power supply of the coin-acceptor unit or of the automatic machine.

What is claimed is:

1. Coin guiding device (1) which contains a coin channel (2) as well as a swivelling pressing member (4) with wedge-shaped surfaces (9, 10), wherein the pressing member (4) has an intake (6) substantially parallel to a wall (3)

of the coin channel (2) and the intake is delimited by a lateral guide (7) and the coin guiding device (1) has a runner (3) disposed after the pressing member (4).

2. Coin guiding device according to claim 1, wherein the pressing member (4) has an intake slope (8) in the transition region from the intake (6) to the wedge-shaped surfaces (9, 10).

3. Coin guiding device according to claim 1, wherein the pressing member has a first (11) and a second arm (12) with a first (9) and a second wedge-shaped surface (10).

4. Coin guiding device according to claim 3, wherein the first (11) and the second arm (12) are substantially perpendicular to one another.

5. Coin guiding device according to claim 3, wherein the first arm (11) contains the intake (6) as well as the adjoining first wedge-shaped surface (9).

6. Coin guiding device according to claim 3, wherein a swivel pin (13) of the pressing member (4) is substantially parallel to one of the arms (11, 12).

7. Coin guiding device according to claims 3, wherein the first arm (11) is substantially perpendicular to, and/or the second arm (12) is substantially parallel to, the runner (3).

8. Coin guiding device according to claim 6, wherein the swivel pin (13) of the pressing member (4) is disposed perpendicular to the runner (3).

9. Coin guiding device according to claim 1, wherein the guide (7) is so inclined in relation to the supply direction (15) of a coin (14) and/or the orientation of the gravitational field, that the coin (14) rolls away on the guide (7).

10. Coin guiding device according to claim 1, wherein the pressing member (4) can assume a rest position as well as swung out positions and may be returned to the rest position by the force of its own weight.

11. Coin guiding device according to claim 1, having a device for switching on a coin-acceptor unit and/or an automatic machine.

* * * * *